US010040296B2

(12) United States Patent
Funada

(10) Patent No.: US 10,040,296 B2
(45) Date of Patent: Aug. 7, 2018

(54) THERMAL HEAD

(71) Applicant: FUJITSU COMPONENT LIMITED, Tokyo (JP)

(72) Inventor: Kunihiko Funada, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 15/090,940

(22) Filed: Apr. 5, 2016

(65) Prior Publication Data

US 2016/0375698 A1 Dec. 29, 2016

(30) Foreign Application Priority Data

Jun. 23, 2015 (JP) ..... 2015-126007

(51) Int. Cl.
*B41J 2/335* (2006.01)

(52) U.S. Cl.
CPC ..... *B41J 2/3351* (2013.01); *B41J 2/3353* (2013.01); *B41J 2/3354* (2013.01); *B41J 2/3357* (2013.01); *B41J 2/33515* (2013.01); *B41J 2/33525* (2013.01)

(58) Field of Classification Search
CPC .... B41J 2/3351; B41J 2/33525; B41J 2/3353; B41J 2/3354; B41J 2/3357
See application file for complete search history.

(56) References Cited

U.S. PATENT DOCUMENTS 7,673,961 B2 * 3/2010 Shihoh ..... B41J 2/2142 347/14
8,432,421 B2 * 4/2013 Muraki ..... B41J 2/355 347/209
2006/0280539 A1 12/2006 Yamamoto et al.
2010/0275685 A1 * 11/2010 Hanzawa ..... G01F 1/6965 73/204.25
2011/0141215 A1 * 6/2011 Shintani ..... B41J 2/3357 347/200
2012/0147118 A1 6/2012 Daicho

FOREIGN PATENT DOCUMENTS

CN 1849220 10/2006
CN 201264417 7/2009
CN 102107559 6/2011
JP 61-89871 5/1986
(Continued)

OTHER PUBLICATIONS

Japanese Platform for Patent Information, Publication No. 2002-307734, published Oct. 23, 2002.
(Continued)

*Primary Examiner* — Lamson Nguyen
(74) *Attorney, Agent, or Firm* — Staas & Halsey LLP

(57) ABSTRACT

A thermal head including: a common electrode that includes a plurality of comb teeth portions extending in a first direction in which a paper is conveyed; a plurality of discrete electrodes, each of which extends in the first direction, and is arranged between the comb teeth portions; and a resistor that is electrically connected to the comb teeth portions and the discrete electrodes, and has such a shape that two connection positions of two discrete electrodes adjacent to each other and the resistor shift from each other in the first direction.

9 Claims, 12 Drawing Sheets

(56) References Cited

FOREIGN PATENT DOCUMENTS

| | | |
|---|---|---|
| JP | 4-286659 | 10/1992 |
| JP | 7-178946 | 7/1995 |
| JP | 2002-307734 | 10/2002 |
| JP | 2006-103302 | 4/2006 |
| JP | 2006-192703 | 7/2006 |
| JP | 2011-56735 | 3/2011 |

OTHER PUBLICATIONS

Japanese Platform for Patent Information, Publication No. 2006-192703, published Jul. 27, 2006.
Japanese Platform for Patent Information, Publication No. 4-286659, published Oct. 12, 1992.
Japanese Platform for Patent Information, Publication No. 61-89871, published May 8, 1986.
Japanese Platform for Patent Information, Publication No. 2011-56735, published Mar. 24, 2011.
Japanese Platform for Patent Information, Publication No. 7-178946, published Jul. 18, 1995.
Chinese Office Action dated Jun. 7, 2016 in corresponding Chinese Patent Application No. 201610346297.6, 5 pages.

* cited by examiner

THERMAL HEAD

CROSS-REFERENCE TO RELATED APPLICATION

This application is based upon and claims the benefit of priority of the prior Japanese Patent Application No. 2015-126007 filed on Jun. 23, 2015, the entire contents of which are incorporated herein by reference.

FIELD

A certain aspect of the embodiments is related to a thermal head mounted on a thermal printer.

BACKGROUND

Conventionally, there has been known a thermal head mounted on a thermal printer (e.g. see Japanese Laid-open Patent Publication Nos. 2002-307734, 2006-192703, 4-286659, 61-89871, 2011-56735 and 7-178946). In the thermal printer, there is a phenomenon (i.e., a sticking phenomenon) that the thermal paper is stuck on the thermal head at the time of a low temperature. In order to avoid the sticking phenomenon, there are known a method to move a position of a heating element of the thermal head beforehand and a method to decrease a pressure of the thermal head against the thermal paper.

SUMMARY

According to a first aspect of the present invention, there is provided a thermal head including: a common electrode that includes a plurality of comb teeth portions extending in a first direction in which a paper is conveyed; a plurality of discrete electrodes, each of which extends in the first direction, and is arranged between the comb teeth portions; and a resistor that is electrically connected to the comb teeth portions and the discrete electrodes, and has such a shape that two connection positions of two discrete electrodes adjacent to each other and the resistor shift from each other in the first direction.

According to a second aspect of the present invention, there is provided a thermal head including: a common electrode that includes a plurality of comb teeth portions extending in a first direction in which a paper is conveyed; a plurality of discrete electrodes, each of which extends in the first direction, and is arranged between the comb teeth portions; and a plurality of resistors, each of which is electrically connected to the comb teeth portions and the discrete electrodes.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

In the above-mentioned method to move the position of the heating element of the thermal head beforehand and the above-mentioned method to decrease the pressure of the thermal head against the thermal paper, there is a problem that a printing quality decreases in the operation of the thermal head at a normal temperature.

A description will now be given of an embodiment of the present invention with reference to the drawings.

Figure 1:
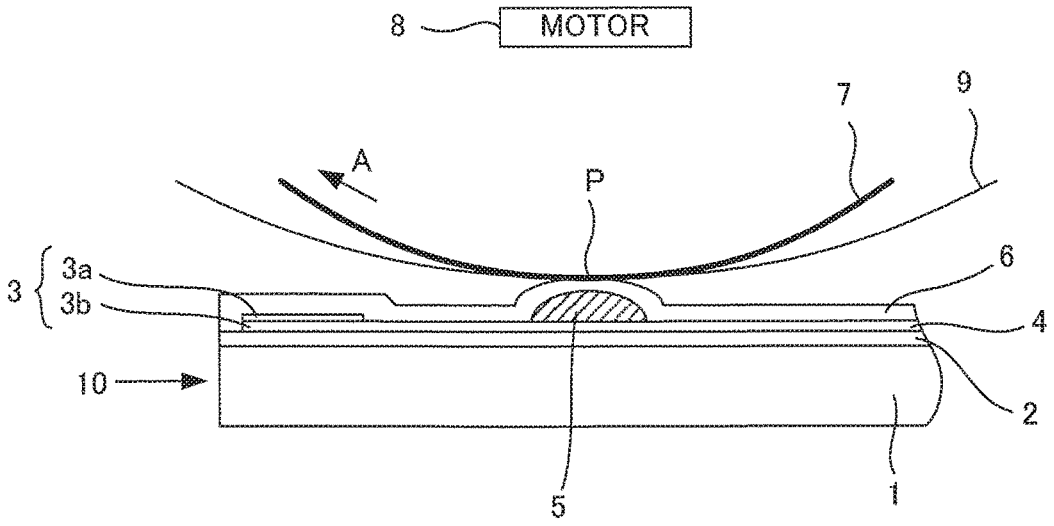
FIG. 1 is a diagram illustrating the schematic configuration of a thick film type thermal head according to a first embodiment.
Figure 2:
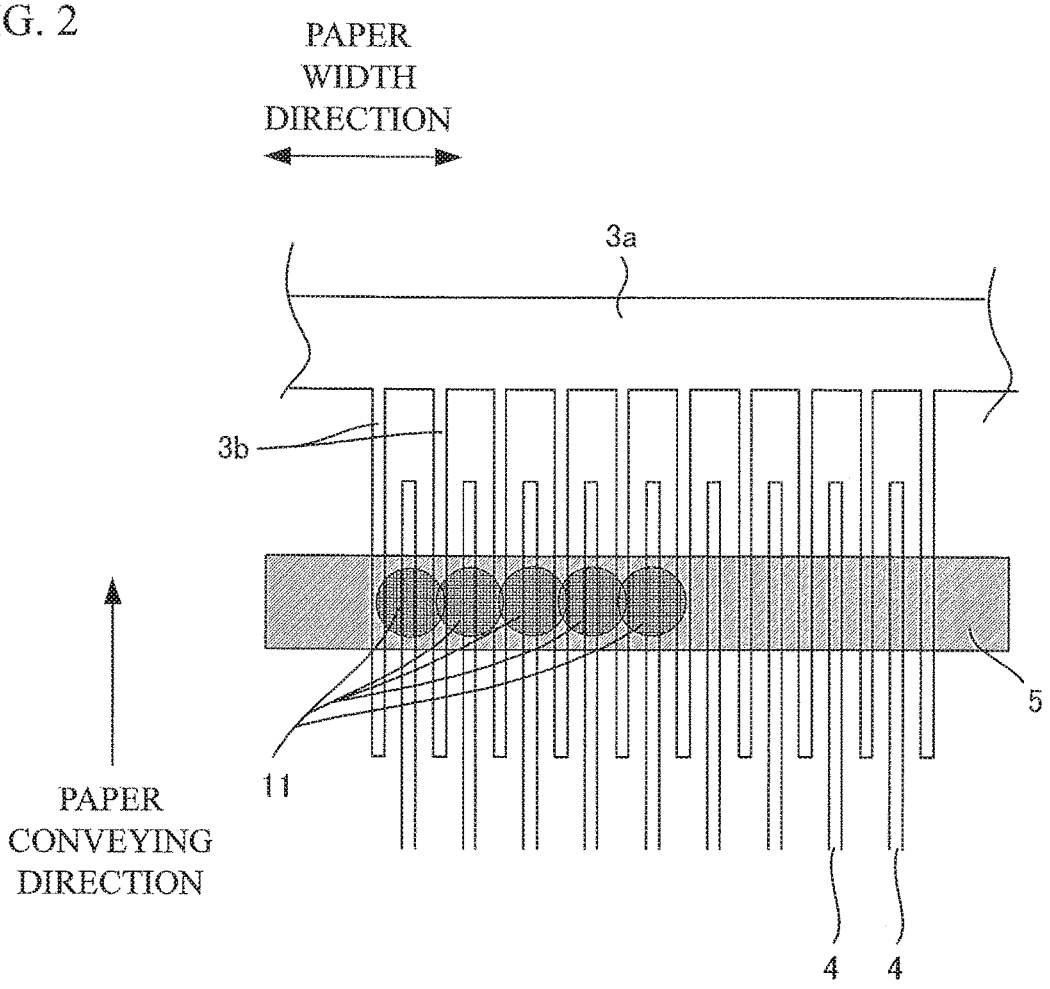
FIG. 2 is a diagram illustrating the configuration of electrodes and a heating resistor of a thick film type thermal head according to a comparative example.
Figure 3:
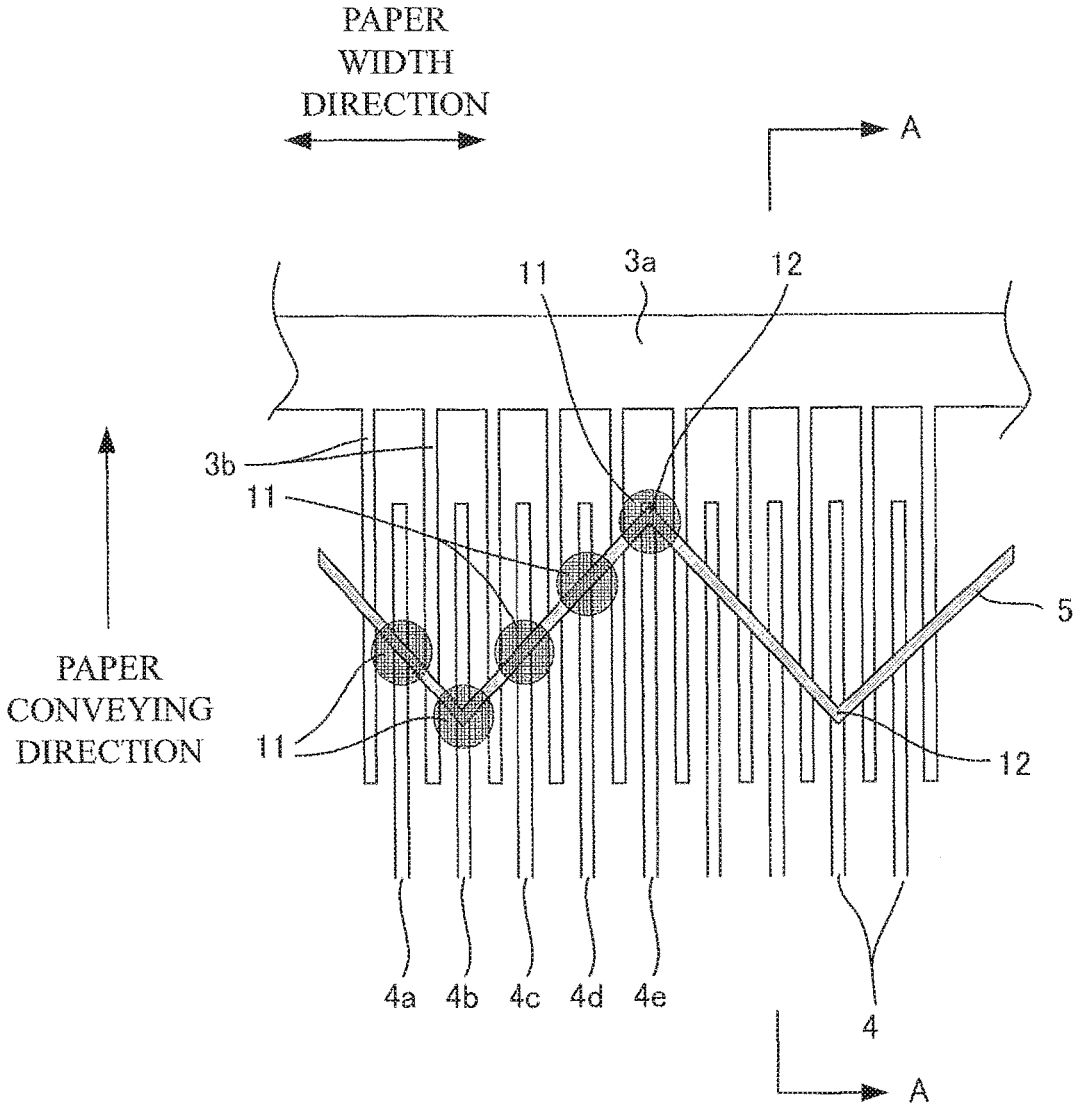
FIG. 3 is a diagram illustrating the configuration of electrodes and a heating resistor of the thick film type thermal head according to the first embodiment.

(FIRST EMBODIMENT) FIG. 1 is a diagram illustrating the schematic configuration of a thick film type thermal head according to a first embodiment. FIG. 2 is a diagram illustrating the configuration of electrodes and a heating resistor of a thick film type thermal head according to a comparative example FIG. 3 is a diagram illustrating the configuration of electrodes and a heating resistor of the thick film type thermal head according to the first embodiment. Here, FIG. 1 corresponds to a cross-section surface views taken on a line A-A of FIG. 3.

A thermal head 10 according to the first embodiment of FIG. 1 is mounted on a thermal printer. As types of the thermal head, there are a thin film type thermal head in which electrodes are arranged on a heating resistor, and a thick film type thermal head in which a heating resistor is arranged on electrodes. In the thermal printer of the present embodiment, the thick film type thermal head is used.

The thermal head 10 includes a substrate 1 such as ceramic, for example. A glaze layer 2 made of an insulator functioning as a heat storage layer is formed on the substrate 1. Moreover, a common electrode 3 and discrete electrodes 4 are formed on the glaze layer 2. Then, a heating resistor 5 is formed on the common electrode 3 and the discrete electrodes 4. The heating resistor 5 is formed by printing or burning with the use of a ruthenium oxide paste. Moreover, the common electrode 3, the discrete electrodes 4 and the heating resistor 5 are covered by a protective layer 6.

In the thermal paper 9, phenolic compound is applied to the surface thereof. A heated part of the phenolic compound melts, so that the thermal paper 9 is printed. The thermal paper 9 is nipped at a contact P between the heating resistor 5 and a rubber roller 7 provided in the thermal printer. The rubber roller 7 is rotated by a stepping motor 8 in the thermal printer, and the thermal paper 9 is conveyed in an arrow direction A in accordance with the rotation of the rubber roller 7.

As illustrated in FIGS. 2 and 3, the common electrode 3 includes a base portion 3*a* extending in a paper width direction perpendicular to a paper conveying direction, and a plurality of comb teeth portions 3*b* extending in a direction opposite to the paper conveying direction from the base portion 3*a*. Moreover, the discrete electrode 4 is provided between each pair of comb teeth portions 3*b*. The heating resistor 5 is formed on the comb teeth portions 3*b* and the discrete electrodes 4, and electrically connected to the comb teeth portions 3*b* and the discrete electrodes 4. Each discrete electrode 4 is connected to a driving transistor, not shown, and the energizing of each discrete electrode 4 is controlled by the driving transistor.

For example, when a single discrete electrode 4 is connected to a ground by the corresponding driving transistor and a voltage is applied to the comb teeth portions 3*b* of the common electrode 3, a current flows into portions of the heating resistor 5 between the discrete electrode 4 connected to the ground and the comb teeth portions 3*b* adjacent thereto, and hence the thermal paper 9 is printed by Joule heat generated from the portions of the heating resistor 5 into which the current flows. In this case, the portions printed by the heating resistor 5 connected between the two adjacent comb teeth portions 3*b* correspond to 1 dot.

The heating resistor 5 according the comparative example of FIG. 2 is formed linearly parallel to the base portion 3*a* of the common electrode 3 (i.e., parallel to the paper width direction).

Here, it is assumed that a current flows into five adjacent pairs of comb teeth portions 3*b*, five dots are formed on the thermal paper 9, and the thermal paper 9 are stuck on the thick film type thermal head of the comparative example at five places. Circular marks of FIG. 2 are five sticking portions 11, and an area of each circular mark indicates a sticking area. Here, each sticking portion 11 corresponds to the portions of the heating resistor 5 generating heat.

Since the five sticking portions 11 are arranged in the paper width direction in FIG. 2, the five sticking portions 11 have to be peeled off at the same time. For this reason, in order to convey the thermal paper 9, a frictional force between the rubber roller 7 and the thermal paper 9 has to exceed a force which peels off the five sticking portions 11 at the same time. That is, when the frictional force between the rubber roller 7 and the thermal paper 9 does not exceed the force which peels off the five sticking portions 11 at the same time, the thermal paper 9 are stuck on the thick film type thermal head of the comparative example, and hence the sticking phenomenon occurs. Here, in FIG. 2, the adjacent sticking portions 11 are partially overlapped with each other On the other hand, the heating resistor 5 according to the first embodiment of FIG. 3 is formed in a zigzag shape (i.e., a folded-line shape) on the comb teeth portions 3*b* and the discrete electrodes 4. For this reason, in the heating resistor 5 of FIG. 3, the heating portions are not arranged linearly in the paper width direction, the adjacent heating portions are shifted from each other in the paper conveying direction. In this case, when a voltage is applied to the comb teeth portions 3*b* of the common electrode 3, the driving transistors are made to operate and the discrete electrodes 4*a* to 4*e* are connected to the ground, five adjacent dots are formed on the thermal paper 9. Here, although the discrete electrodes 4 are distinguished from the discrete electrodes 4*a* to 4*e* for convenience of explanation, the discrete electrodes 4*a* to 4*e* are the same as the discrete electrodes 4.

When the five dots are printed linearly on the thermal paper 9 in an example of FIG. 3, the operation timings of the driving transistors corresponding to the respective discrete electrodes 4*a* to 4*e* need to be changed in accordance with the rotational timing of the stepping motor 8, i.e., the conveying timing of the thermal paper 9. In the example of FIG. 3, the driving transistors are made to operate so that the discrete electrodes 4*a* to 4*e* are connected to the ground in an order of the discrete electrodes 4*b*, 4*a* and 4*c*, 4*d* and 4*e* in accordance with the conveying timing of the thermal paper 9. Thereby, the five dots can be printed linearly.

Hereinafter, a description will be given of an example in which energization timings to the respective discrete electrodes 4 are shifted. However, when rigorous linear printing is not required, the respective discrete electrodes 4 may be energized at the same time.

A description will be given of a formation process of the five dots in detail. First, when the discrete electrode 4*b* is connected to the ground, a corresponding part of the heating resistor 5 generates heat, one dot is formed on the thermal paper 9 and the thermal paper 9 is conveyed in accordance with the rotation of the stepping motor 8. At this time, if the frictional force between the rubber roller 7 and the thermal paper 9 exceeds a force which peels off a single sticking portion 11 on the discrete electrode 4*b* to suppress the sticking phenomenon, the frictional force is enough.

Next, when the discrete electrodes 4*a* and 4*c* are connected to the ground, two corresponding parts of the heating resistor 5 generate heat to form two dots on the thermal paper 9, the stepping motor 8 rotates and the thermal paper 9 is conveyed. At this time, if the frictional force between the rubber roller 7 and the thermal paper 9 exceeds a force which peels off two sticking portions 11 on the discrete electrodes 4*a* and 4*c*, the frictional force is enough. If the thermal paper 9 stuck on the discrete electrode 4*b* at the time of the energization to the discrete electrode 4*b* is peeled off by paper conveying after the energization to the discrete electrode 4*b*, the number of sticking portions 11 needed to be peeled off at this time is only two.

Next, the discrete electrode 4*d* is connected to the ground, one dot is formed, the stepping motor 8 rotates and the thermal paper 9 is conveyed. At this time, if the frictional force between the rubber roller 7 and the thermal paper 9 exceeds the force which peels off the single sticking portion 11 on the discrete electrode 4*d*, the frictional force is enough.

Lastly, the discrete electrode 4*e* is connected to the ground, one dot is formed, the stepping motor 8 rotates and the thermal paper 9 is conveyed. At this time, if the frictional force between the rubber roller 7 and the thermal paper 9 exceeds the force which peels off the single sticking portion 11 on the discrete electrode 4*e*, the frictional force is enough.

Thus, the heating resistor 5 is formed in the zigzag shape (i.e., the folded-line shape), so that the timings in which the dots are printed on the same positions in the paper conveying direction can be shifted from each other, and the timings in which the dots generate the sticking can be shifted from each other. Therefore, the timings for peeling off the sticking portions 11 (five sticking portions 11 in the example of FIG. 3) are dispersed, and hence the number of sticking portions 11 needed to be peeled off at the same time decreases, compared with the example of FIG. 2. Accordingly, the force needed to peel off the sticking portions 11 in the present embodiment becomes smaller than the force needed to peel off the sticking portions 11 in the example of FIG. 2, and hence it is possible to suppress the sticking phenomenon without decreasing the printing quality.

Here, when the respective discrete electrodes 4*a* to 4*e* are energized at the same time in the example of FIG. 3, the dots are printed on the thermal paper 9 at the same time and hence the sticking of the thermal paper 9 also may take place at the same time. However, the respective sticking portions 11 are not arranged on a line in the paper width direction, and are shifted in the paper conveying direction. For this reason, the timings for peeling off the respective sticking portions 11 shift from each other by a shift amount between the respective sticking portions 11 in the paper conveying direction. Accordingly, also in this case, the number of the sticking portions 11 needed to peel off at the same time can decrease, compared with the example of FIG. 2.

That is to say, the heating resistor 5 has such a shape that two adjacent heat generating portions on the heating resistor 5, i.e., two connection positions of the discrete electrodes 4 adjacent to each other and the heating resistor 5 (e.g. positions on the discrete electrodes 4*a* and 4*b*) shift from each other in the paper conveying direction. Therefore, the timings for peeling off the sticking portions 11are dispersed, and hence it is possible to suppress the sticking phenomenon without decreasing the printing quality.

In FIG. 3, a bending apex 12 of the heating resistor 5 is disposed on the discrete electrode 4, but the bending apex 12 may not be disposed on the discrete electrode 4. For example, the bending apex 12 may be disposed between the discrete electrode 4 and the comb teeth portion 3*b*.

It is preferable that a distance between adjacent bending apexes 12 exceeds a distance between the discrete electrode 4 and the comb teeth portion 3*b* adjacent to each other. Moreover, it is more preferable that the distance between the adjacent bending apexes 12 is equal to or more than a distance between adjacent comb teeth portions 3*b* or a distance between adjacent discrete electrodes 4. This is because more timings for peeling off the sticking portions 11 can be formed by not disposing the adjacent heat generating portions on the heating resistor 5 on a line in the paper width direction.

Figure 4:
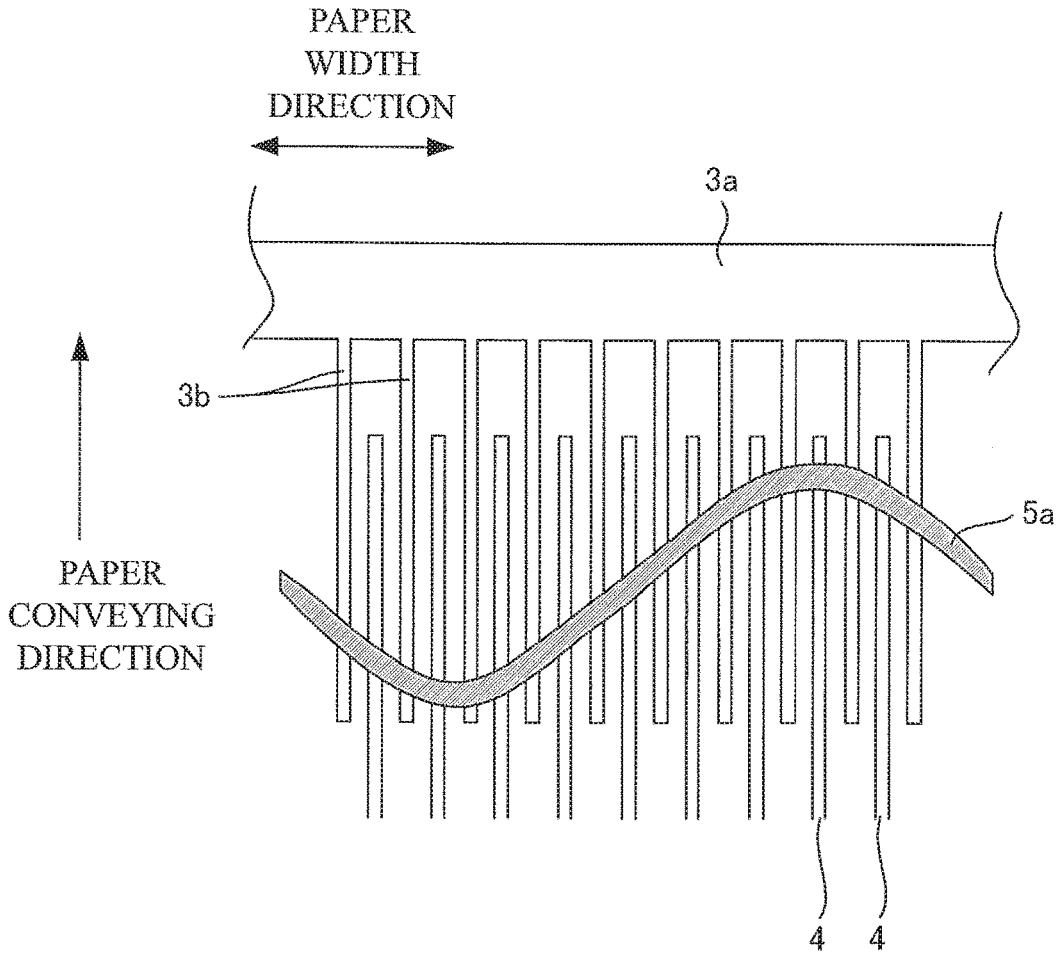
FIG. 4 is a diagram illustrating a first variation example of the heating resistor.
Figure 5:
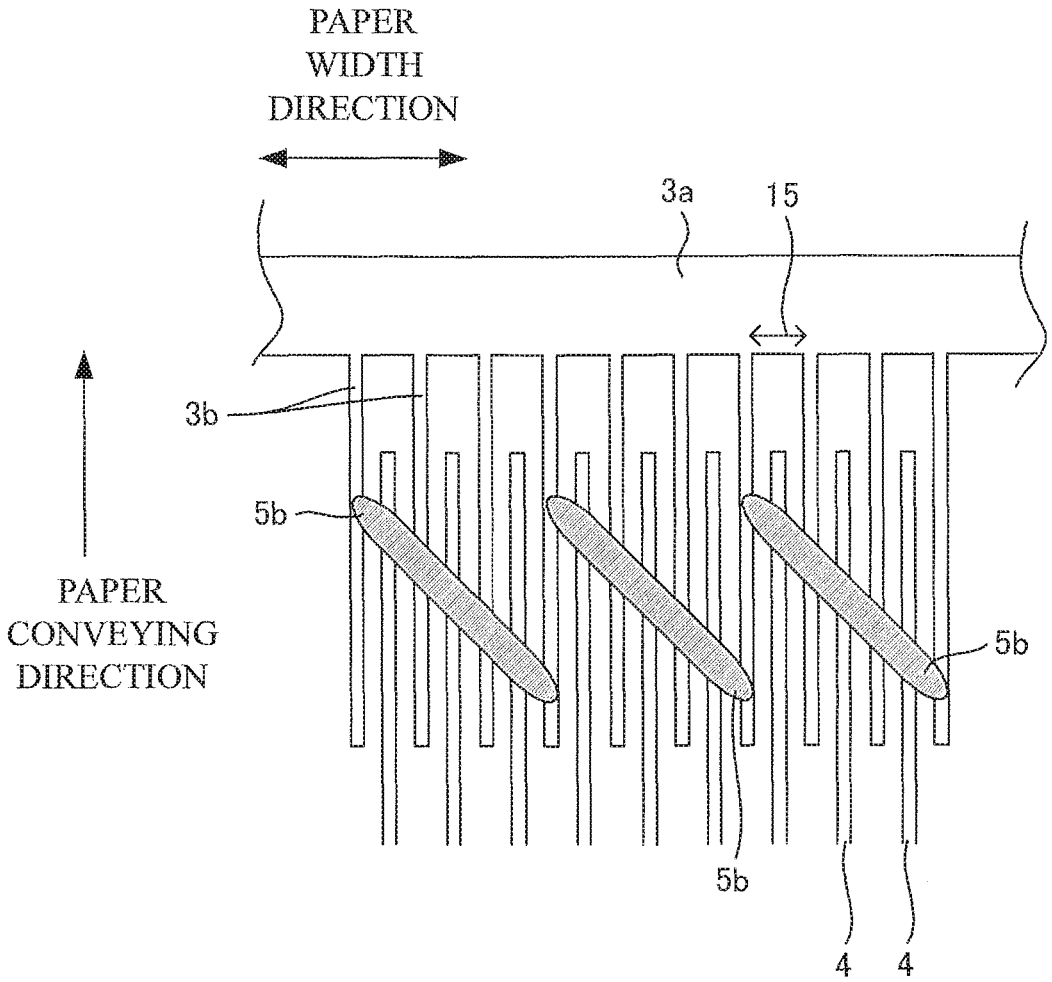
FIG. 5 is a diagram illustrating a second variation example of the heating resistor.
Figure 6:
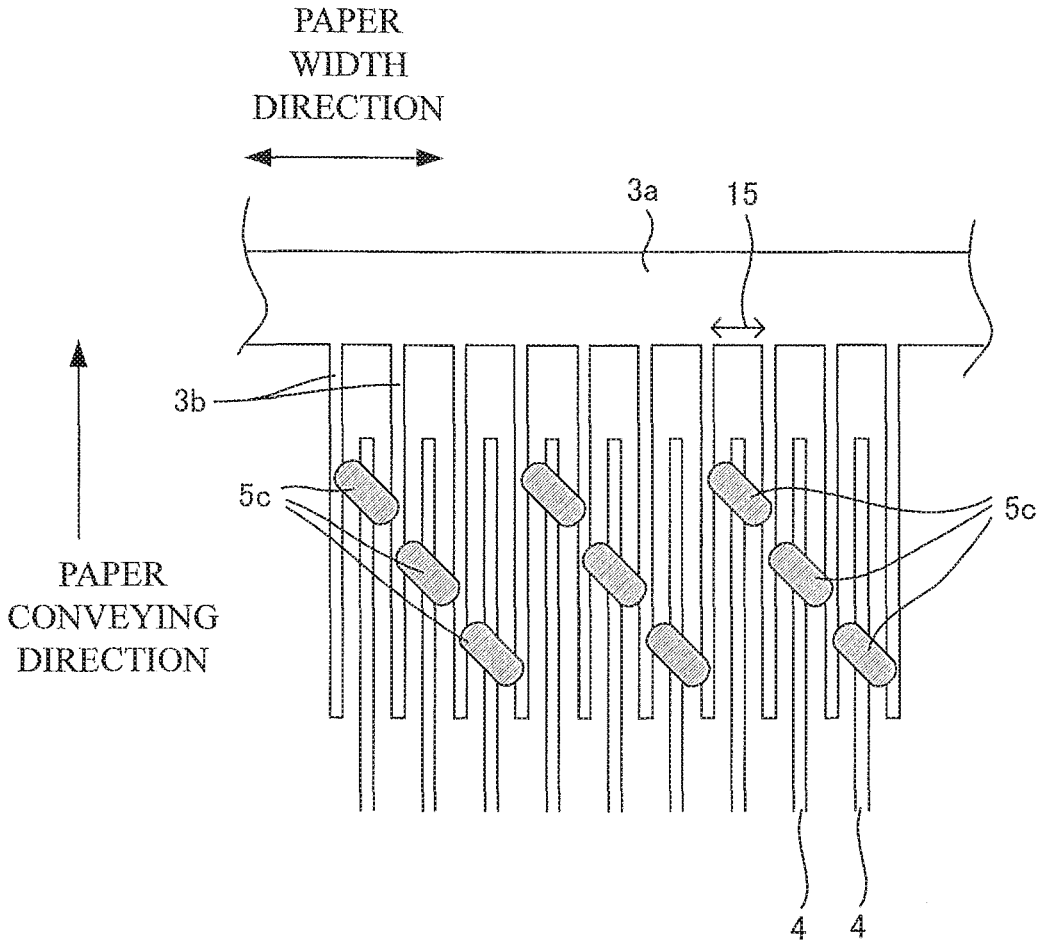
FIG. 6 is a diagram illustrating a third variation example of the heating resistor.
Figure 7:
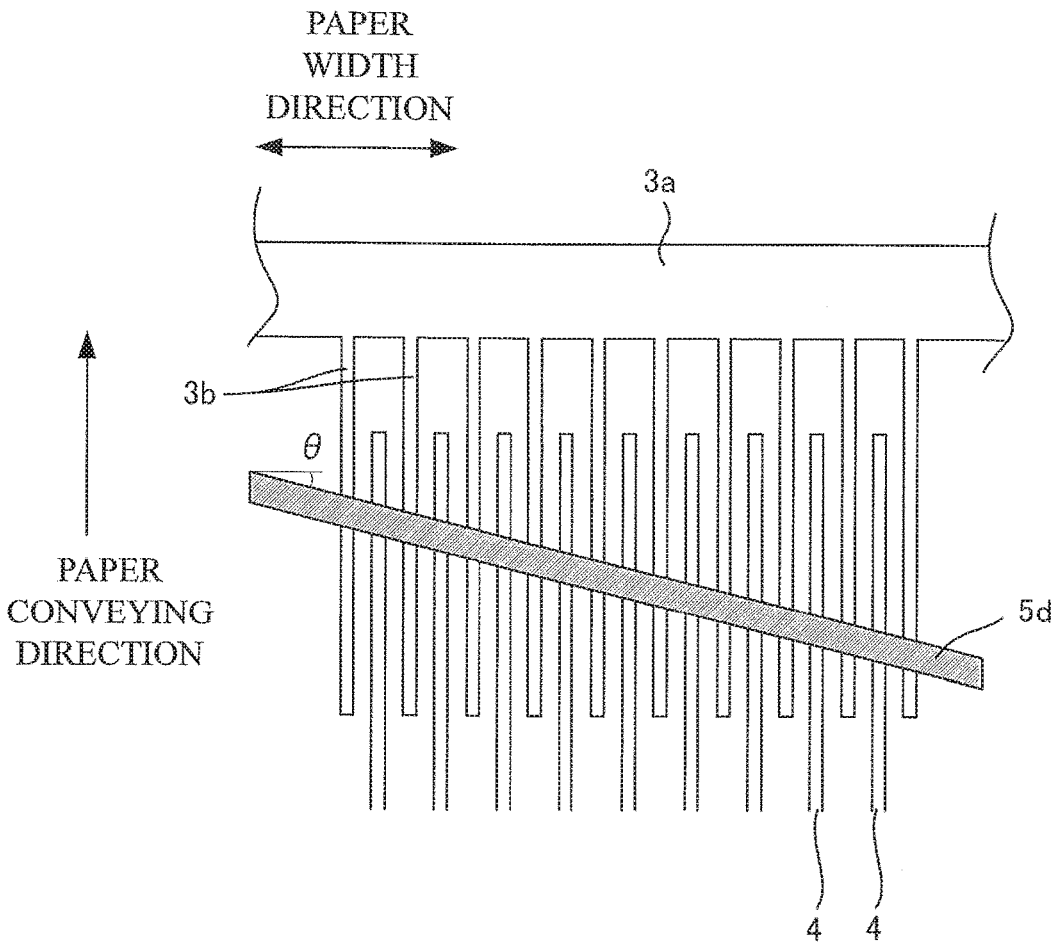
FIG. 7 is a diagram illustrating a fourth variation example of the heating resistor.

FIG. 4 is a diagram illustrating a first variation example of the heating resistor. FIG. 5 is a diagram illustrating a second variation example of the heating resistor. FIG. 6 is a diagram illustrating a third variation example of the heating resistor. FIG. 7 is a diagram illustrating a fourth variation example of the heating resistor.

In FIG. 4, a heating resistor 5*a* is formed in a waveform curve such as a sine curve. In FIG. 5, heating resistors 5*b* are formed as a plurality of discontinuous straight line shapes. In FIG. 6, heating resistors 5*c* are formed as a plurality of discontinuous straight line shapes which are shorter than heating resistors 5*b*. When a pitch (i.e., a length) of the heating resistor 5*b* or 5*c* in the paper width direction is identical with a length of n times (n =natural number) of a pitch (i.e., a distance 15 between the comb teeth portions 3*b*) of wiring patterns as illustrated in FIGS. 5 and 6, a heat generating area of the heating resistor 5*b* or 5*c* corresponding to 1 dot is the same as that of the heating resistor 5 (i.e., continuous heating resistor) corresponding to 1 dot even if the heating resistor 5*b* or 5*c* is discontinuous, and hence the heating resistor 5*b* or 5*c* can obtain the same heating value as the heating resistor 5. In FIG. 7, the heating resistor 5*d* is formed in a straight line shape inclined at angle θ with respect to the paper width direction or a straight line shape diagonally intersecting the comb teeth portions 3*b* and the discrete electrodes 4 which are parallel to the paper conveying direction.

Also in the case of the heating resistors 5*a* to 5*d*, the timings for peeling off the sticking portions are dispersed, and hence it is possible to suppress the sticking phenomenon.

As described above, according to the first embodiment, the heating resistor 5 has such a shape that two connection positions of the discrete electrodes 4 adjacent to each other and the heating resistor 5 (i.e., the two adjacent heat generating portions on the heating resistor 5) shift from each other in the paper conveying direction. Therefore, the timings for peeling off the sticking portions are dispersed, and hence it is possible to suppress the sticking phenomenon without decreasing the printing quality.

Figure 8:
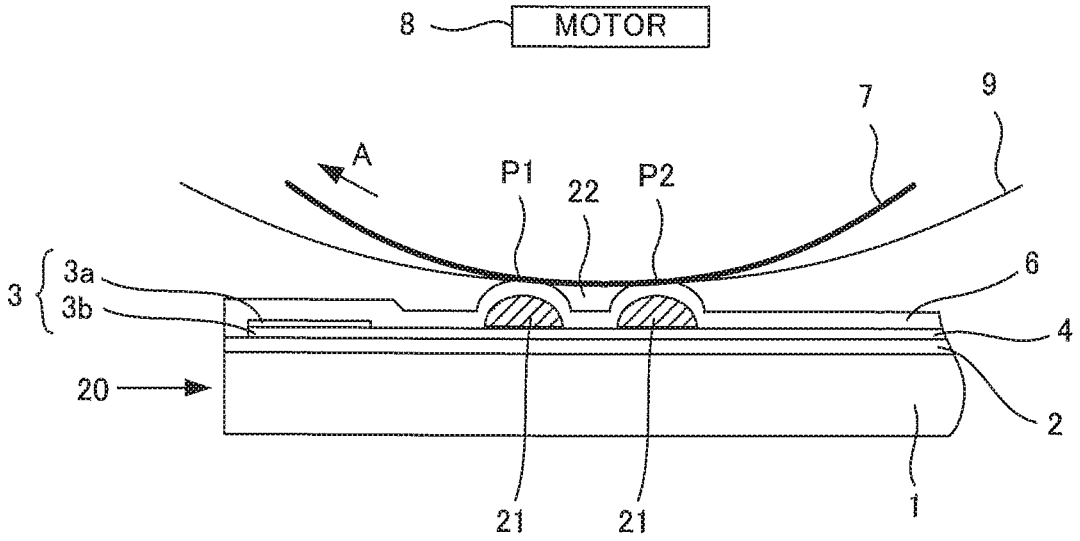
FIG. 8 is a diagram illustrating the schematic configuration of the thick film type thermal head according to a second embodiment.
Figure 9:
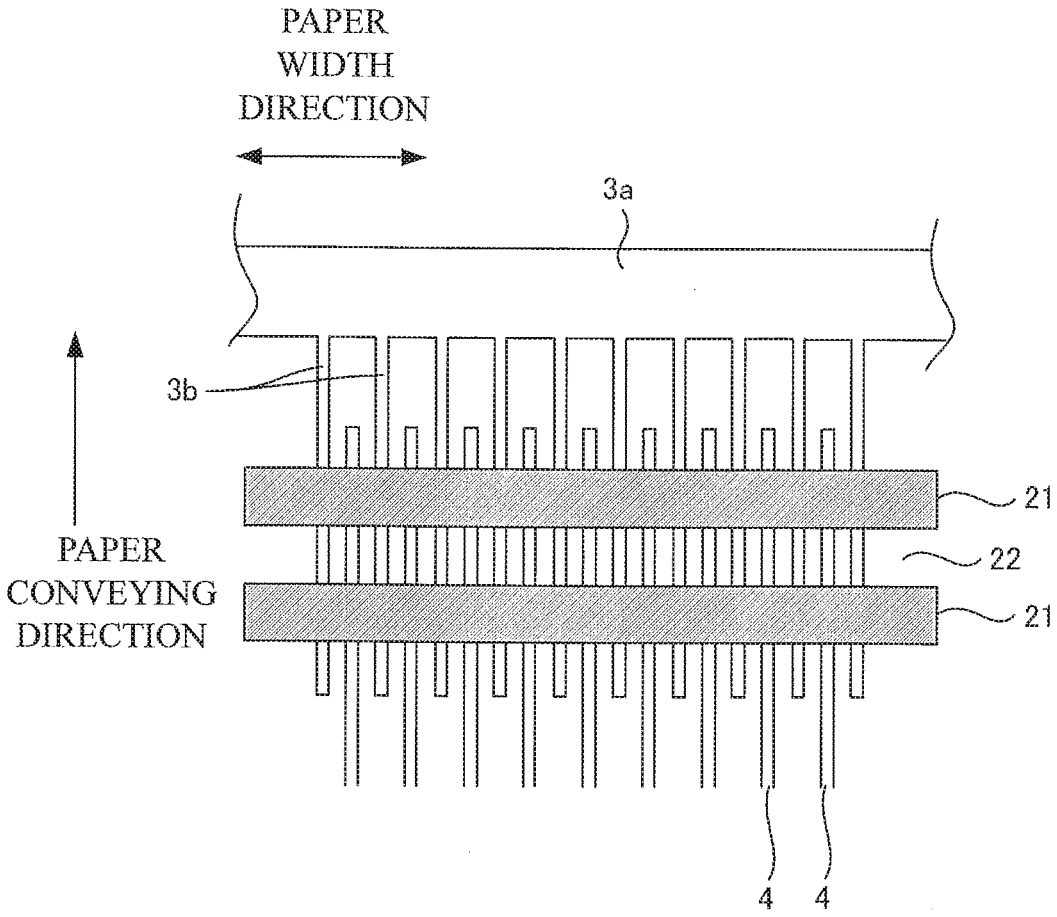
FIG. 9 is a diagram illustrating electrodes and heating resistors of the thick film type thermal head according to the second embodiment.

(SECOND EMBODIMENT) FIG. 8 is a diagram illustrating the schematic configuration of the thick film type thermal head according to a second embodiment. FIG. 9 is a diagram illustrating electrodes and heating resistors of the thick film type thermal head according to the second embodiment. A thick film type thermal head 20 according to the second embodiment is different in the number and the shape of heating resistors from the thick film type thermal head 10 according to the first embodiment. Hereinafter, the same components as the thick film type thermal head 10 in the first embodiment are designated by the same reference numerals, and description of these components is omitted.

The thick film type thermal head 20 according to the second embodiment includes the substrate 1, the glaze layer 2, the common electrode 3 and the discrete electrodes 4, as with the thick film type thermal head 10. Then, two heating resistors 21 are formed on the common electrode 3 and the discrete electrodes 4. Each of the heating resistors 21 is formed by printing or burning with the use of a ruthenium oxide paste. The heating resistors 21 are arranged parallel to the base portion 3*a* (i.e., in the paper conveying direction) so as to sandwich an air gap 22. Moreover, each heating resistor 21 is formed on the comb teeth portions 3*b* and the discrete electrodes 4, and electrically connected to the comb teeth portions 3*b* and the discrete electrodes 4.

The thermal paper 9 is nipped at contacts P1 and P2 between the heating resistors 21 and the rubber roller 7 provided in the thermal printer. At this time, since the air gap 22 is formed between the contacts P1 and P2, the thermal paper 9 is not in close contact with the thick film type thermal head 20 and easily peels off from the thick film type thermal head 20. Thereby, it is possible to suppress the sticking phenomenon. Moreover, since there are the two contacts P1 and P2, it is possible to disperse a contact pressure to the rubber roller 7 from the thick film type thermal head 20, compared with the case of the single contact P as illustrated in FIG. 1. As a result, since a sticking force of the thermal paper 9 applied to each of the contacts P1 and P2 can be reduced more than a sticking force of the thermal paper 9 applied to the single contact P, it is possible to suppress the sticking phenomenon.

In FIGS. 8 and 9, the two heating resistors 21 are the same heating resistors, but a resistance material having different resistivity may be used for each heating resistor 21.

Figure 10:
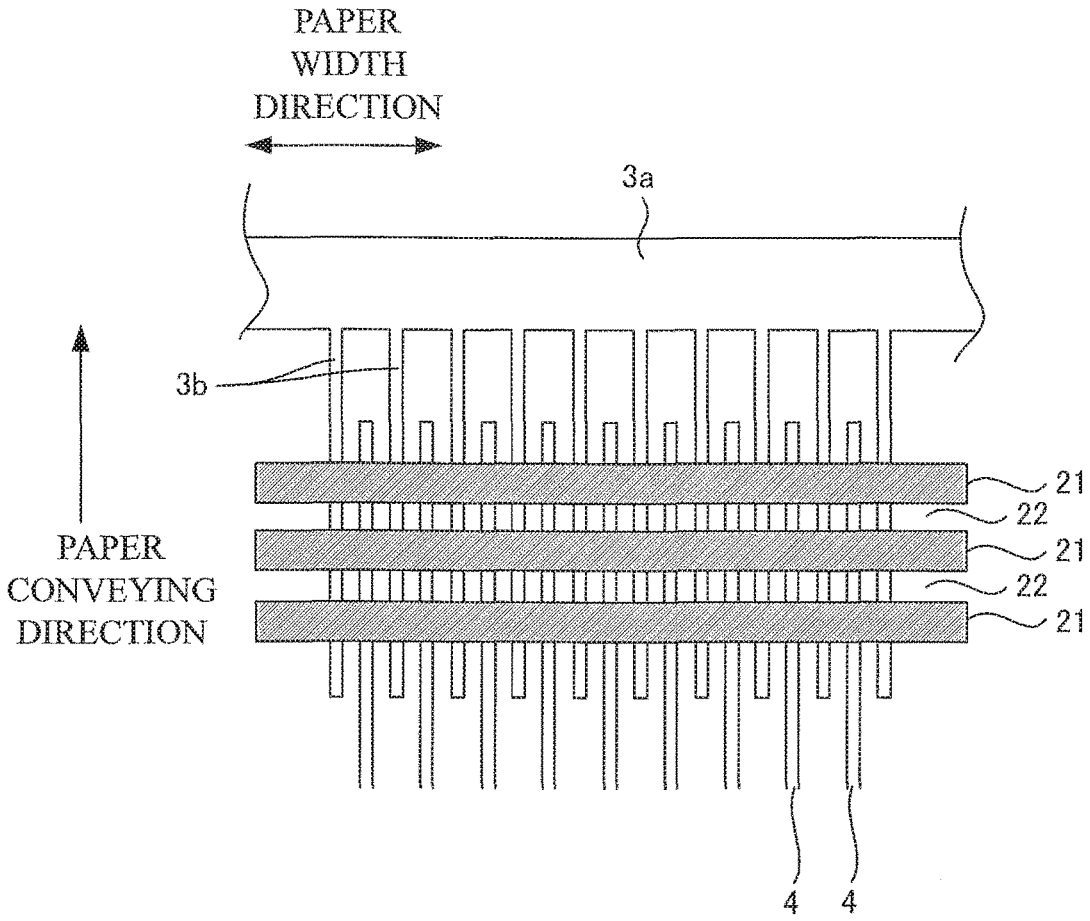
FIG. 10 is a diagram illustrating a fifth variation example of the heating resistors.
Figure 11:
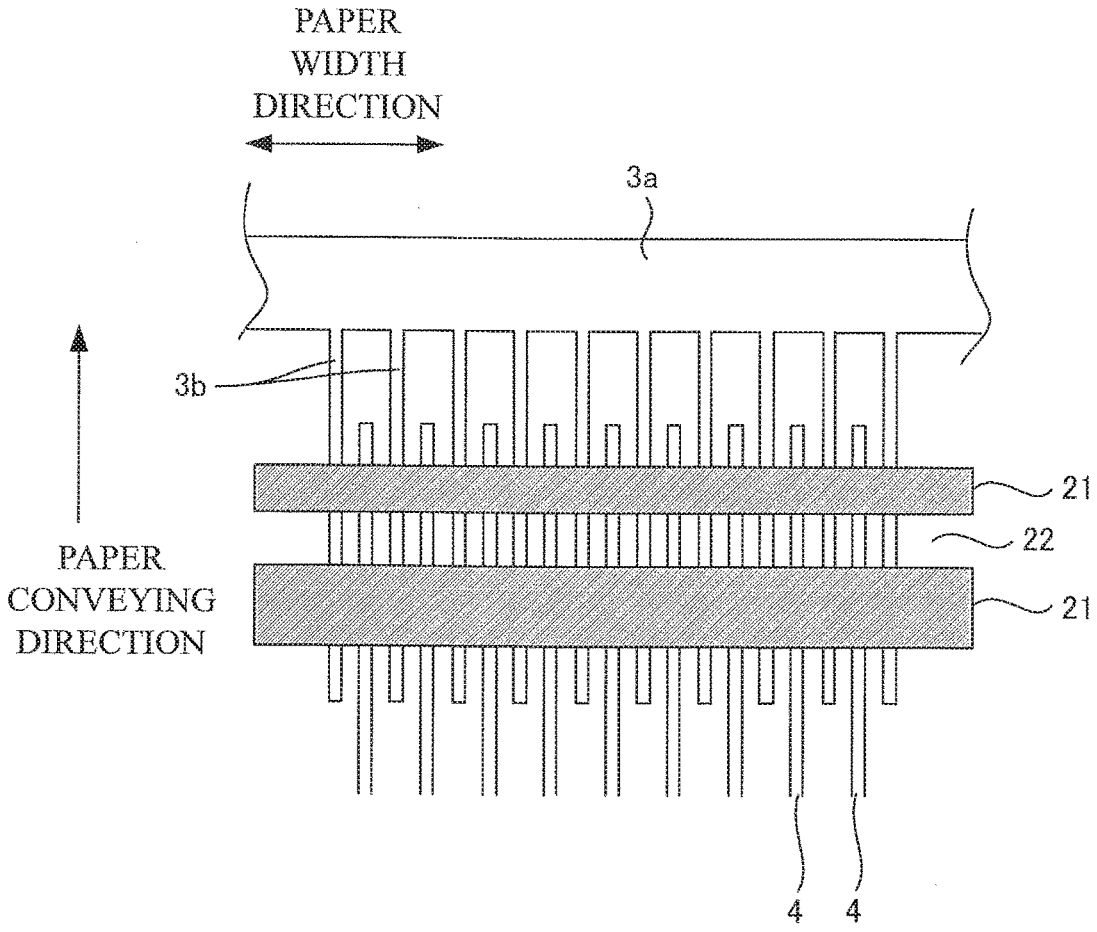
FIG. 11 is a diagram illustrating a sixth variation example of the heating resistors.
Figure 12:
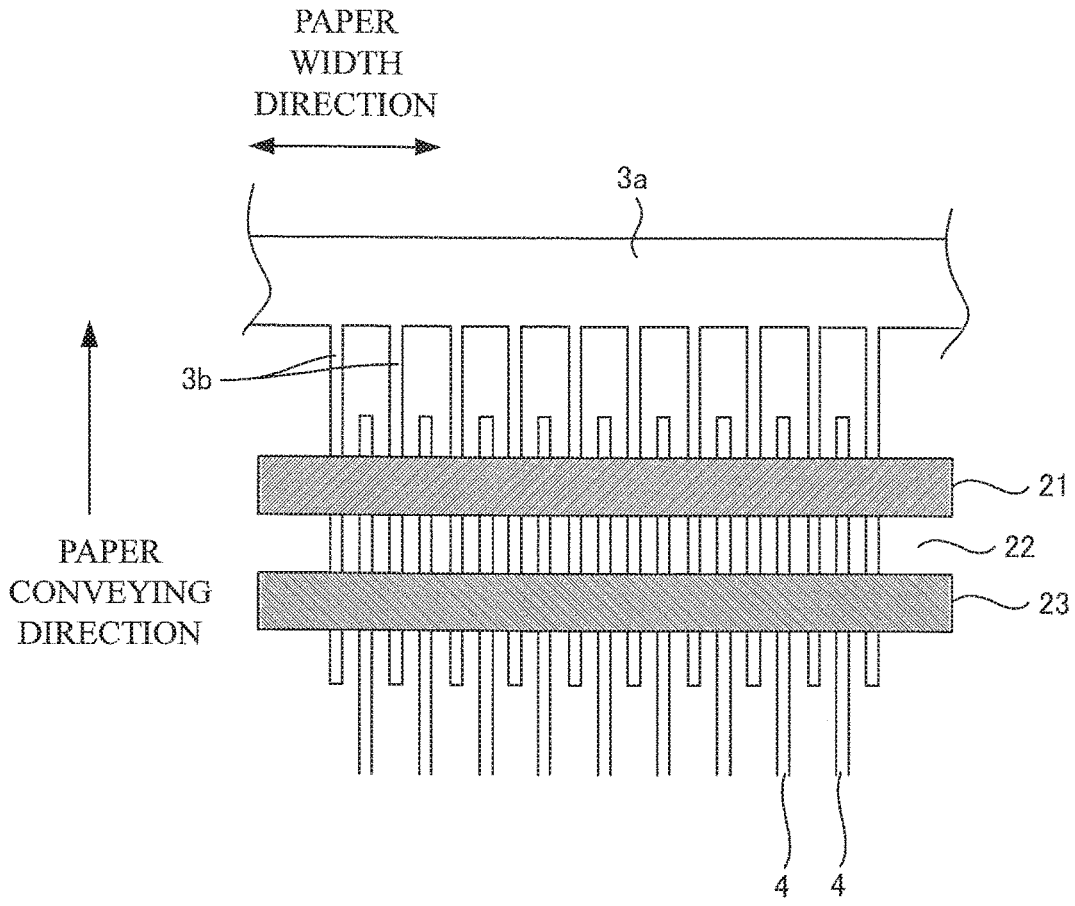
FIG. 12 is a diagram illustrating a seventh variation example of the heating resistors.

FIG. 10 is a diagram illustrating a fifth variation example of the heating resistors. FIG. 11 is a diagram illustrating a sixth variation example of the heating resistors. FIG. 12 is a diagram illustrating a seventh variation example of the heating resistors.

In FIG. 10, three heating resistors 21 are formed on the common electrode 3 and the discrete electrodes 4. In this case, two air gaps 22 are formed by the three heating resistors 21.

In FIG. 11, the thicknesses (the widths of two heating resistors 21 in the paper conveying direction) of the two heating resistors 21 differ from each other. Thus, since the thickness is changed for each heating resistor 21, the contact pressure to the rubber roller 7 from the thick film type thermal head 20 and the sticking force of the thermal paper 9 applied to each contact can be controlled.

In FIG. 12, a resistor 23 is an insulator and a non-heating dummy resistor. In this case, the resistor 23 does not contribute to the printing to the thermal paper 9, but can disperse the contact pressure and form the air gap 22 between the heating resistor 21 and the resistor 23. As a result, as with the example of FIG. 8, the thermal paper 9 easily peels off from the thick film type thermal head 20 and hence it is possible to suppress the sticking phenomenon.

As described above, according to the second embodiment, the thick film type thermal head 20 includes the plurality of heating resistors 21 (in the example of FIG. 12, the heating resistor 21 and the resistor 23). Therefore, the thermal paper 9 easily peels off from the thick film type thermal head 20 by the air gap 22 formed between the heating resistors 21. Moreover, since there are a plurality of nip positions corresponding to the heating resistors 21, it is possible to disperse the contact pressure to the rubber roller 7 from the thick film type thermal head 20, and suppress the sticking phenomenon without decreasing the printing quality.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various change, substitutions, and alterations could be made hereto without departing from the spirit and scope of the invention.

What is claimed is:

1. A thermal head comprising:

a common electrode that includes a plurality of comb teeth portions extending in a first direction in which a paper is conveyed;

a plurality of discrete electrodes, each of which extends in the first direction, and is arranged between two adjacent comb teeth portions among the plurality of the comb teeth portions; and a resistor that is electrically connected to the plurality of comb teeth portions and the discrete electrodes, wherein the resistor and the plurality of discrete electrodes are connected at a plurality of connection positions respectively, adjacent connection positions among the plurality of connection positions shift from each other in the first direction.

2. The thermal head as claimed in claim 1, wherein the resistor has a zigzag shape or a waveform.

3. The thermal head as claimed in claim 1, wherein the resistor has a straight line shape diagonally intersecting the plurality of comb teeth portions and the discrete electrodes.

4. A thermal head comprising:

a common electrode that includes a plurality of comb teeth portions extending in a first direction in which a paper is conveyed;

a plurality of discrete electrodes, each of which extends in the first direction, and is arranged between the comb teeth portions; and a plurality of resistors that are arranged in the first direction, each of which is electrically connected to the comb teeth portions and the discrete electrodes.

5. The thermal head as claimed in claim 4, wherein the widths of the resistors in the first direction differ from each other.

6. The thermal head as claimed in claim 4, wherein the resistors include at least one non-heating resistor.

7. The thermal head as claimed in claim 4, wherein each of the plurality of discrete electrodes is arranged between two adjacent comb teeth portions among the plurality of the comb teeth portions.

8. A thermal head comprising:

a resistor that generates heat by energization and performs printing on a thermal paper by the generated heat;

wherein the resistor is formed so that heat generating positions of the resistor adjacent to each other in a width direction of the thermal paper shift along a conveying direction of the thermal paper.

9. The thermal head as claimed in claim 8, wherein the adjacent heat generating positions shift along the conveying direction just after the energization.

* * * * *